US005511782A

United States Patent [19]

Maley

[11] Patent Number: 5,511,782

[45] Date of Patent: Apr. 30, 1996

[54] BALL GAME DEVICE AND METHOD OF USING THE SAME

[76] Inventor: Jerry P. Maley, 1812 S. Third, Bismarck, N. Dak. 58504

[21] Appl. No.: 386,676

[22] Filed: Feb. 10, 1995

[51] Int. Cl.[6] ..... A63B 67/00

[52] U.S. Cl. ..... 273/93 R; 273/58 R; 273/146; 273/411

[58] Field of Search ..... 273/88, 93 R, 273/146, 58 R, 411

[56] References Cited

U.S. PATENT DOCUMENTS

| | | | |
|---|---|---|---|
| 1,587,580 | 6/1926 | Dutton | 273/146 |
| 1,765,625 | 6/1930 | Snover | 273/93 R |
| 2,430,681 | 11/1947 | Johnson | 273/146 X |
| 2,631,854 | 3/1953 | Volman | 273/93 R |
| 3,008,719 | 11/1961 | Misko | 273/144 |
| 3,931,971 | 1/1976 | Harvey | 273/58 R X |
| 5,078,408 | 1/1992 | Myers | 273/428 |

*Primary Examiner*—William H. Grieb
*Attorney, Agent, or Firm*—David A. Lingbeck

[57] ABSTRACT

A ball game device and method of using the same comprising a spherical body made of a resilient material preferably durable plastic or rubber and dimensioned to be kicked or struck on a playing surface either indoors or outdoors. The spherical body has eight equally-sized faces all of which are generally flat-surfaced for resting upon the surface. Each face has indicia displayed thereupon which describes and displays an outcome in a baseball game. Base members have words displayed thereon which correspond or are synonyms to the indicia displayed on the spherical body. The face facing upwardly on the surface after the spherical body comes to rest on the surface upon being struck, kicked, or rolled by the user determines the fate of the user in the ball game.

9 Claims, 7 Drawing Sheets

BALL GAME DEVICE AND METHOD OF USING THE SAME

BACKGROUND OF THE INVENTION

The present invention relates to a ball game device and method of using the same, for playing a ball game indoors and/or outdoors.

Game devices and ball games are well known in the art, but none describe a device and a method of using the same as described in the present invention.

One known prior art is a GAME APPARATUS, U.S. Pat. No. 2,430,681, which comprises a hollow block in the form of a truncated block with a passage extending through a top thereof, through which granular material is passed.

Another known prior art is a GAME DEVICE, U.S. Pat. No. 3,008,719, which comprises a marble depositing chamber having a plurality of circumferentially spaced marble receptacles detachably mounted about the periphery thereof with the device capable of being rolled over a surface and having a port through which the marbles can be put inside thereof.

Also, another known prior art is a PROJECTILE HAVING INDENTED SURFACE AREAS, U.S. Pat. No. 3,931,971, which comprises a body member having a spherical shape with six equally-sized indentations therein with each indentation having an annular rim and having raised indicia on the spherical surface inside the rim and further having a dimple formed on the spherical surface thereof which is used for amusement.

Further, another known prior art is a BOUNCING CUBE, U.S. Pat. No. 5,078,408, which comprises a spherical ball of high density material forming the center of the cube which comprises identical sides and comprises low density material which buckles under impact causing the spherical ball in the cube to react to the impact and respond as a ball.

Yet, another known prior art is a SIMULATED BASEBALL GAME, U.S. Pat. No. 2,631,854, which comprises a base of nonmetallic material, a playing surface delineated to simulate a baseball field including a home plate and carrying indicia to indicate scoring values, a plurality of metal blocks on the bases, which are magnetized to attract a ball of magnetized material.

The ball game device and the method of using the same in the present invention is not described, anticipated, nor suggested in any of the prior art and is definitely useful for children and adults of all talents and abilities, who can equally compete with other children and adults having either greater or less ability as themselves and who, otherwise, would be prevented from actively participating in a ball game as such.

SUMMARY OF THE INVENTION

The present invention relates to a ball game device and method of using the same, which comprises a substantially spherical or round body preferably made of a resilient material such as rubber or plastic or the like and which has eight equally-sized faces. The faces of the spherical or round body are flat-surfaced and have edges which are rounded to substantially prevent injury to the user and to facilitate rolling of the round body rather than tumbling of the round body such as objects which have distinct sides rather than faces. Each face of the spherical body has indicia thereon, which describes an event in a baseball or softball game. The faces have the words "OUT", "SINGLE", "DOUBLE", "TRIPLE", and "HOME RUN", and the numerals "1", "2", "3", and "4" displayed on them. The spherical body is dimensioned and adapted to be kicked or hit in some fashion by a user and is allowed to roll not tumble on a surface either indoors or outdoors such as a playground or in a gymnasium. The game is played much like the conventional kickball game, except the user's or player's outcome in this game is determined by what is displayed on the face of the spherical body, which is facing upward relative to the surface after the spherical body stops rolling. If the words "HOME RUN" and the numeral "4" is facing upward on the spherical body after the spherical body stops rolling, the user is awarded a home run. If the word "OUT" is face up on the spherical body after the spherical body stops rolling, the user is out. The ball game can be played much like a conventional baseball or softball game where base members are positioned in much like the bases and home plate on a ball field, the base members having distinct colors to match the colors on the faces of the spherical body.

It is an object of the present invention to provide a ball game device and method of using the same which allows users who are physically disabled to compete and play a ball game equally with users who are not physically disabled.

Another object of the present invention is to provide a ball game device and method of using the same which does more than provide an activity and entertainment but also teaches children to match synonyms and numbers.

Also, another object of the present invention is to provide a ball game device and method of using the same which teaches children to match a color on a face of the spherical body with the same color on a base member.

Yet, another object of the present invention is to provide a ball game device and method of using the same which allows users of all ages to play the same game with each other without the bigger or more athletic users being given an advantage over the smaller or less athletic users.

Further objects and advantages of the present invention will become more apparent as the description proceeds and when taken in conjunction with the accompanying drawings wherein:

DETAILED DESCRIPTION OF THE INVENTION

Figure 1:
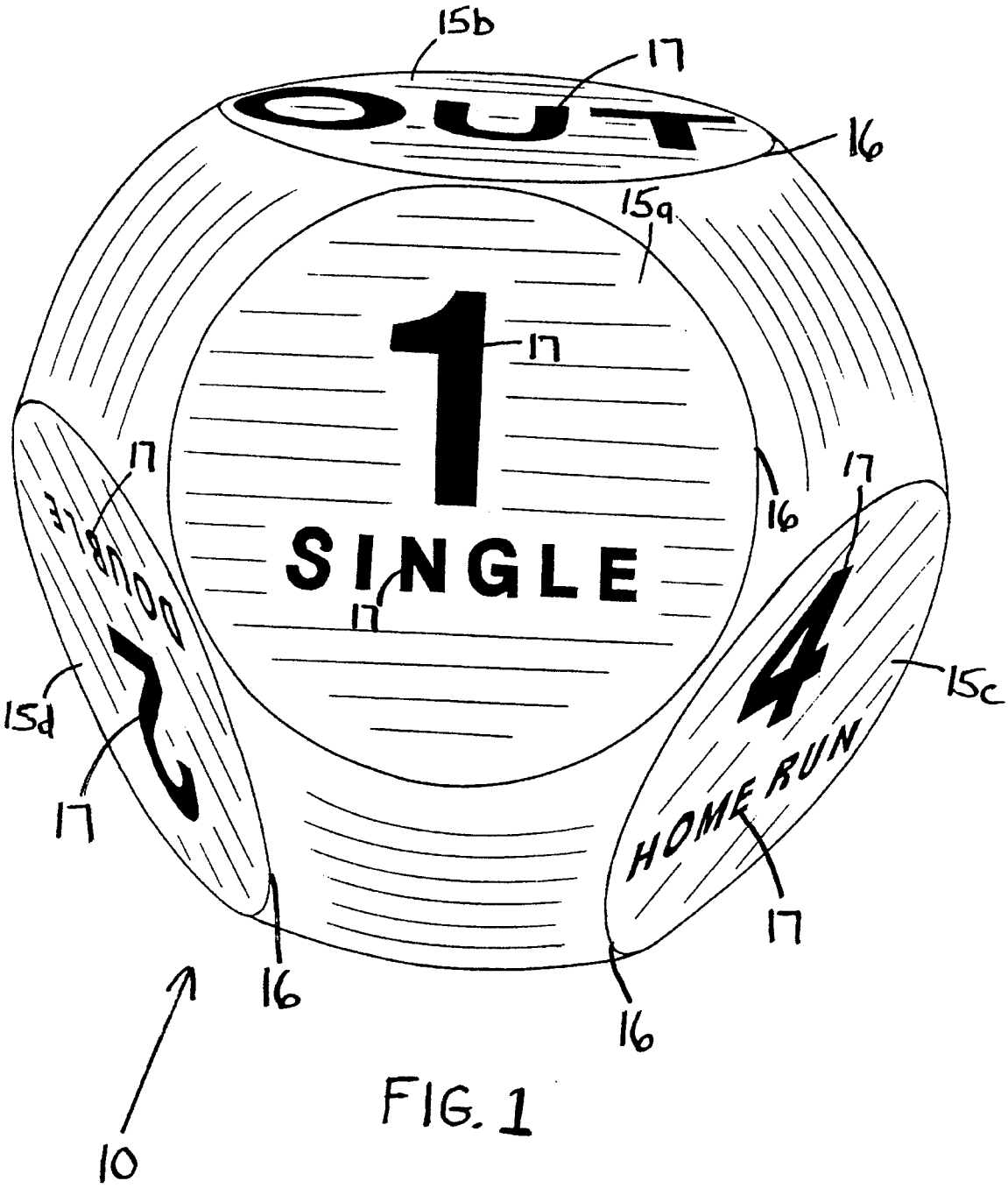
FIG. 1 is a top plan view of the ball game device.
Figure 2:
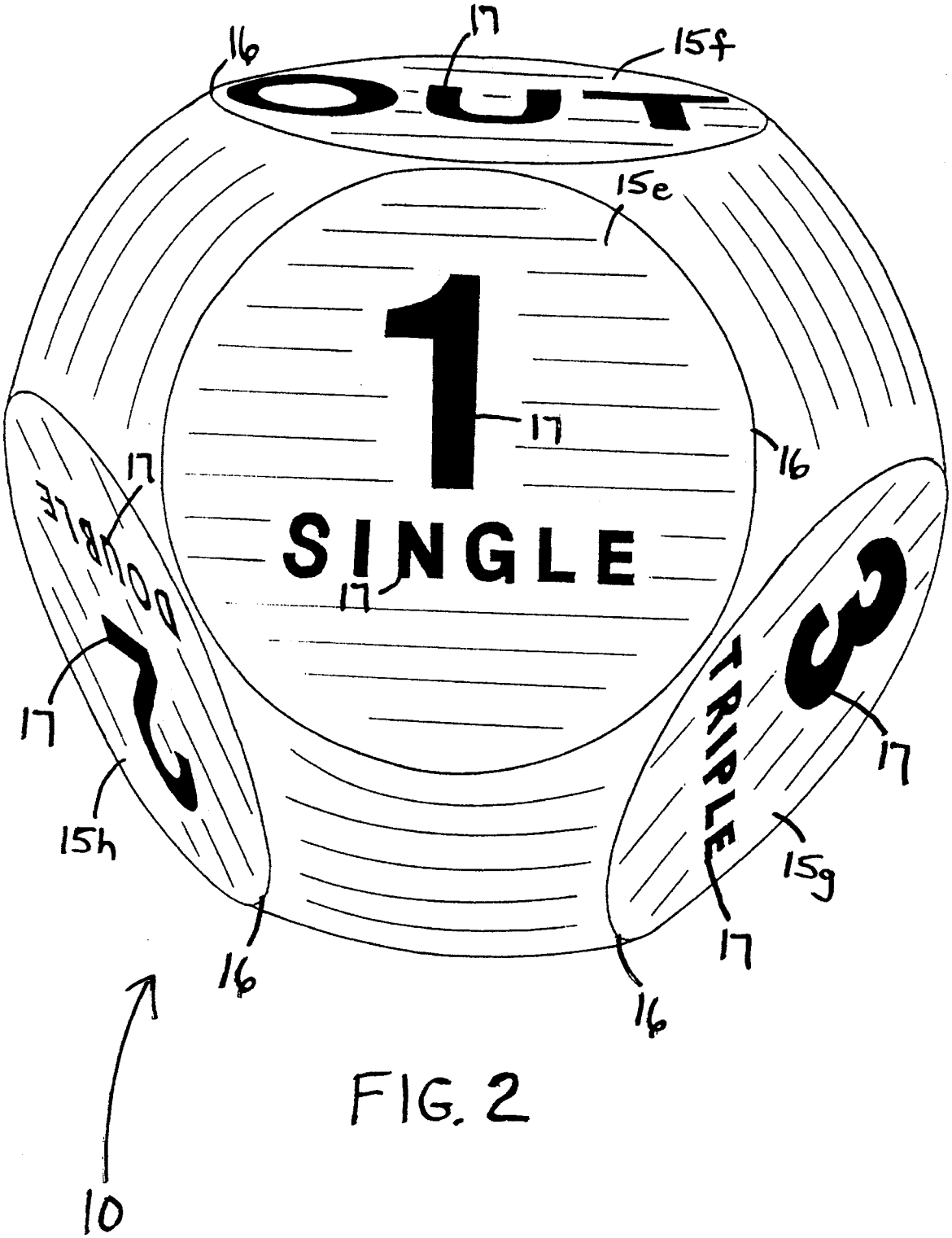
FIG. 2 is a bottom plan view of the ball game device.
Figure 3:
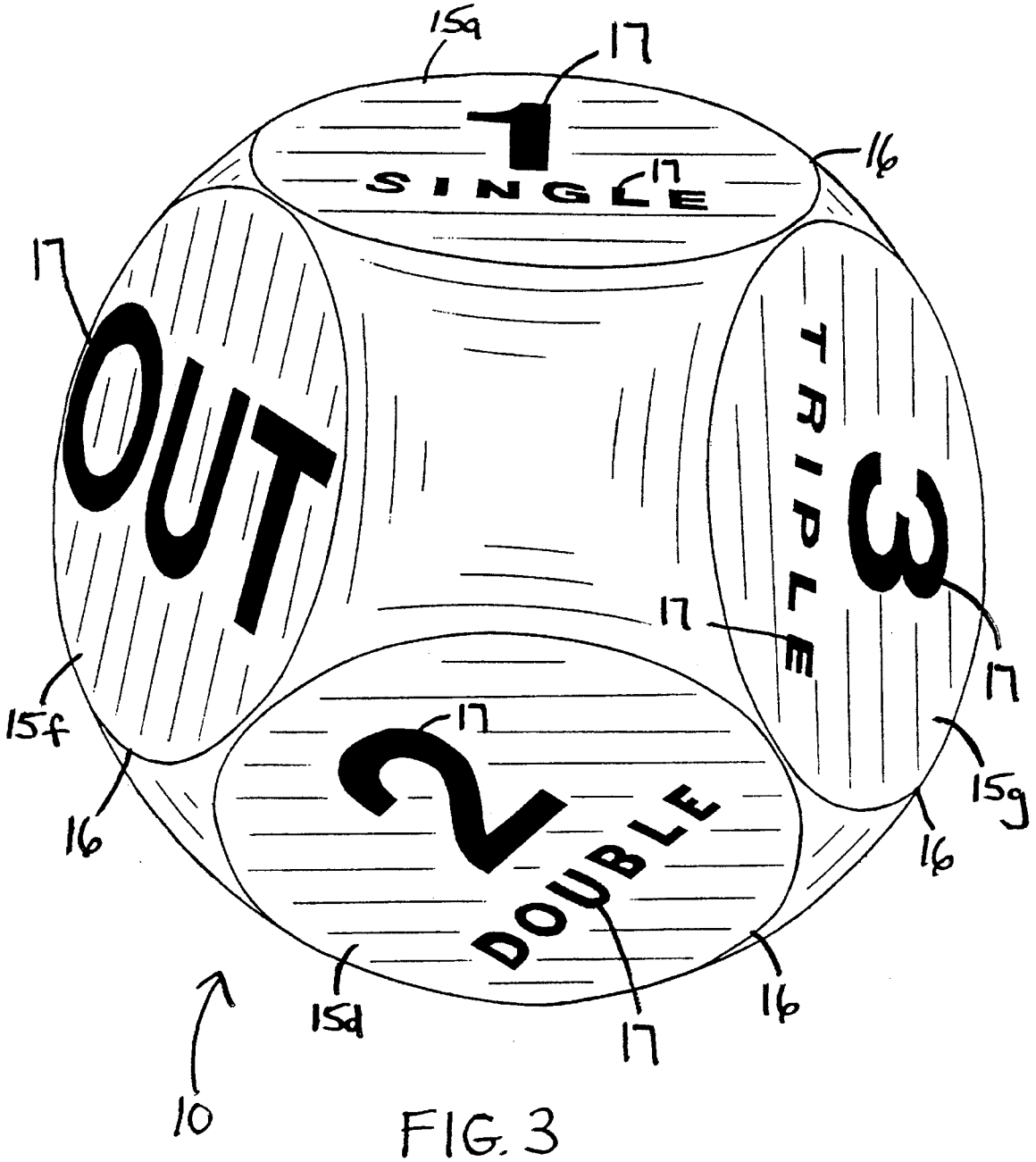
FIG. 3 is a first side elevation view of the ball game device.
Figure 4:
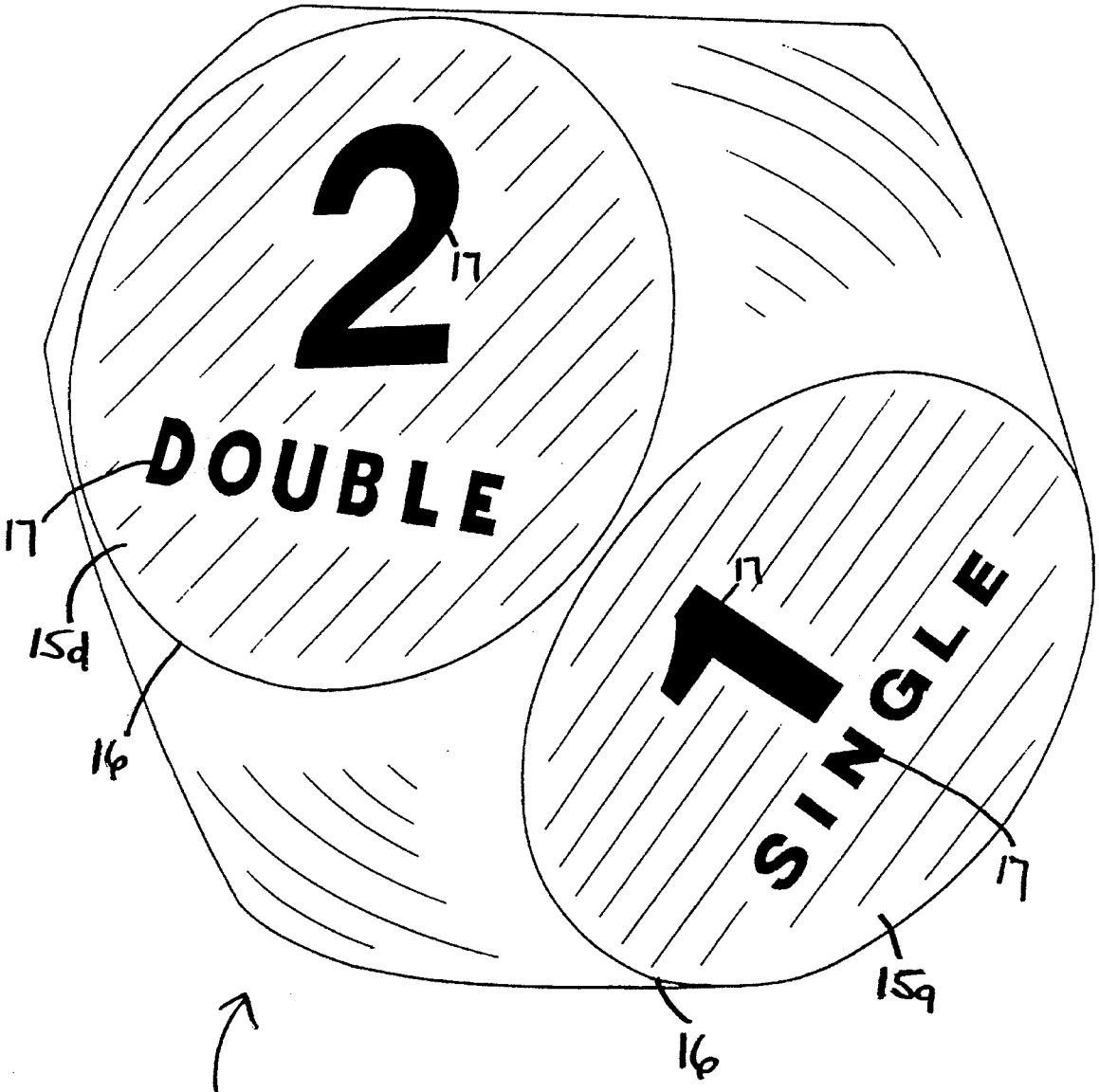
FIG. 4 is a second side elevation view of the ball game device.
Figure 5:
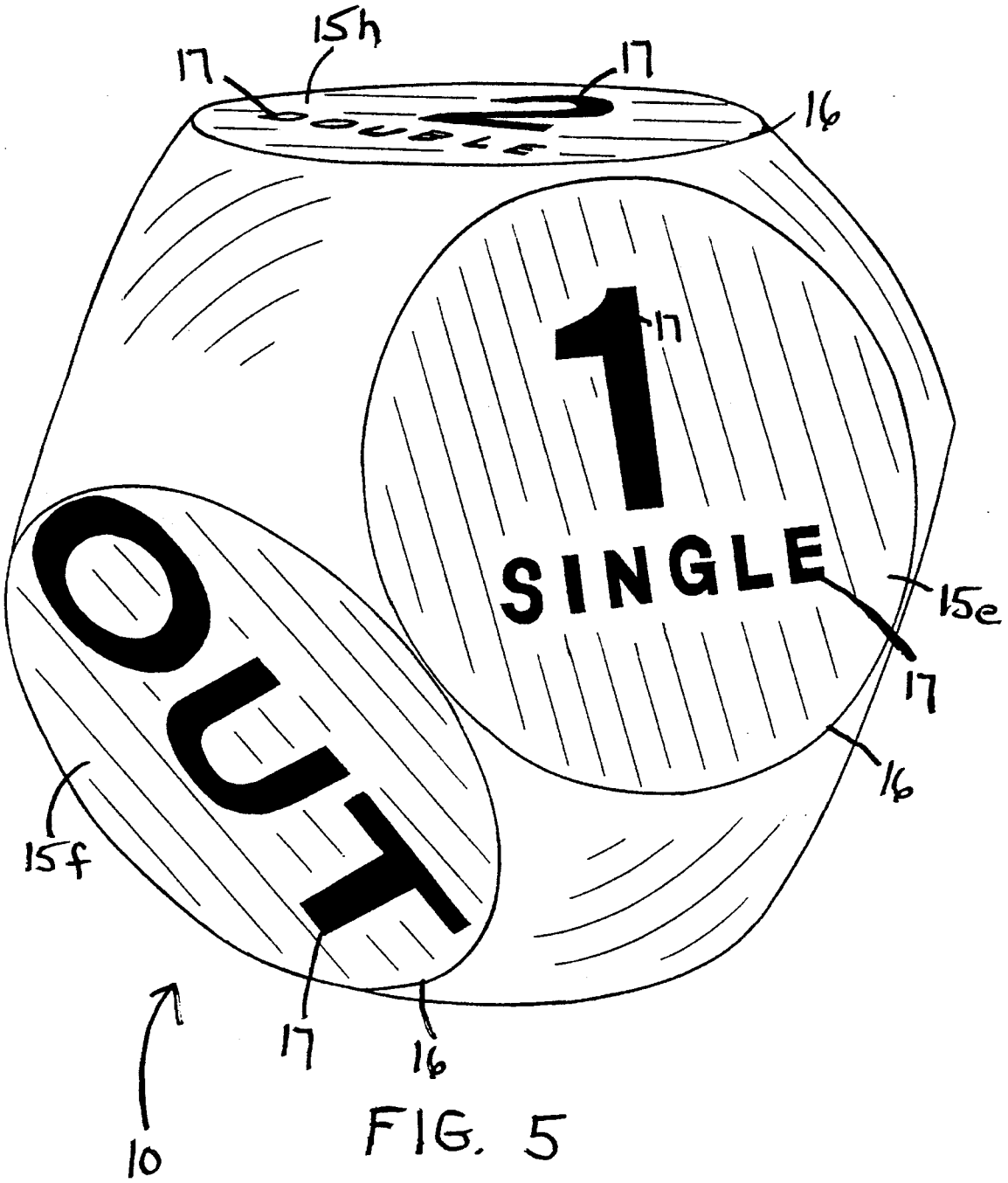
FIG. 5 is a third side elevation view of the ball game device.
Figure 6:
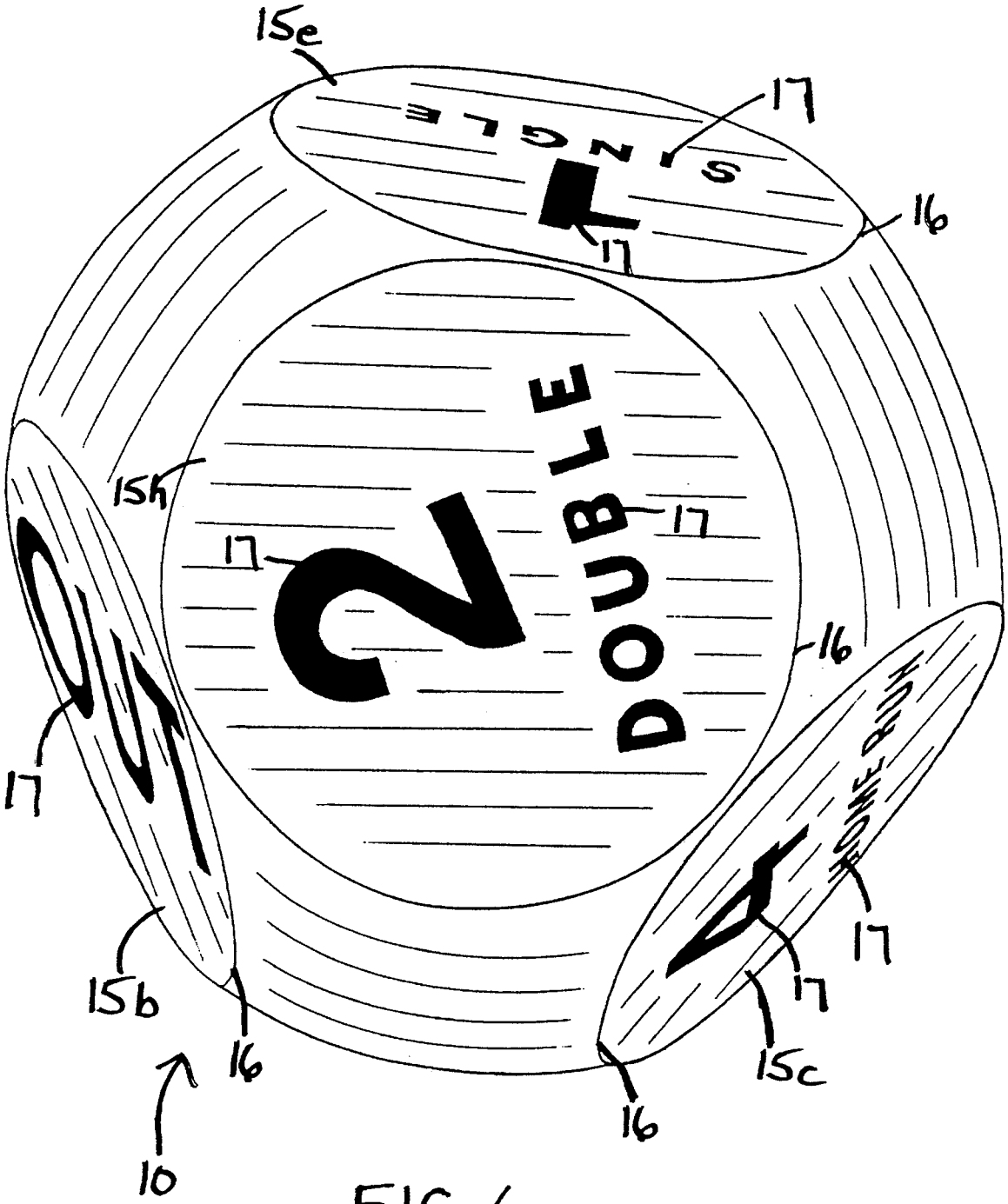
FIG. 6 is a fourth side elevation view of the ball game device.
Figure 7:
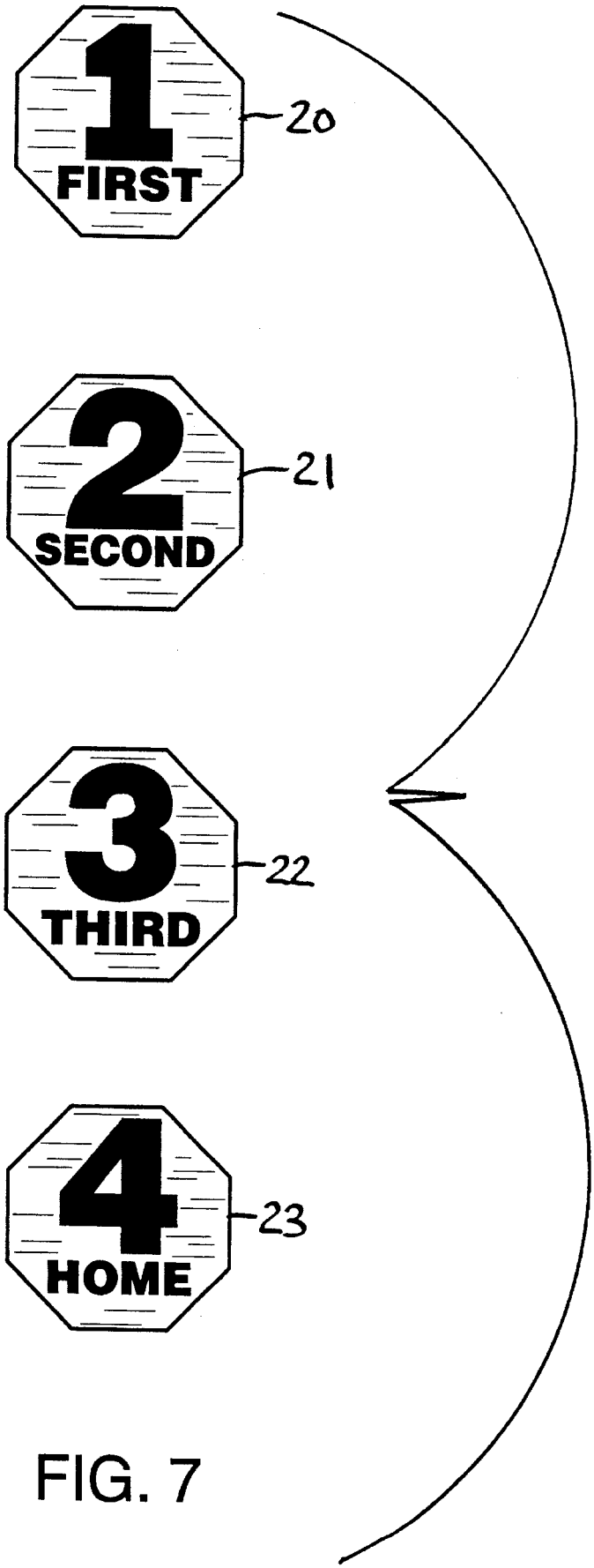
FIG. 7 is a top plan view of the base members.

Referring to the drawings in FIGS. 1 through 7, the ball game device and method of using the same comprises a spherical or round body 10 having a dimension such that a user can easily kick the spherical body 10 with his/her foot upon a surface. The spherical body 10 is preferably made of a resilient material such as plastic or rubber or the like and has substantially eight equally-sized, generally circular-shaped faces 15 which are substantially flat-surfaced and which are spaced about the circumference of the spherical body and which have edges 16 that are rounded to prevent injury to the user and to facilitate rolling of the spherical body 10 on a surface such as the ground or a floor such as the gymnasium. All eight of the faces 15*a–h* are essentially flat indentations in and are circumferentially spaced about the spherical body 10. The faces 15*a–h* each have indicia 17 displayed thereon which describe probable outcomes in a baseball or softball game. Preferably, two of the faces 15*a–h* have the word "OUT" displayed thereon and are colored alike so that the ball game device 10 not only provides entertainment and exercise for a user but also is a learning tool from which children in particular can differentiate between colors especially for children who have a learning disability. The spherical body 10 further has the word "SINGLE" and the numeral "1" displayed on at least one of the remaining faces 15*a–h*. All the faces 15*a–h* displaying the word "SINGLE" and the numeral "1" are colored alike and are distinctively colored relative to the other faces 15*a–h*. Further, the word "DOUBLE" and the numeral "2" are exclusively displayed on at least one of the faces 15*a–h* which is distinctively colored relative to the other faces 15*a–h*. Also, the word "TRIPLE" and the numeral "3" are exclusively displayed on at least one of the faces 15*a–h* which has its own distinctive color relative to the other faces 15*a–h*. In addition, the words "HOME RUN" and the numeral "4" are exclusively displayed upon one face which has its own distinctive color.

The faces 15*a–h* of the spherical body 10 are dimensioned to rest on any type of surface so that upon the user kicking, striking, or rolling the spherical body 10, the spherical body 10 will come to rest on one of its faces 15*a–h* with another of its faces 15*a–h* facing upward relative to the surface, the face being generally parallel to the surface. The spherical body 10 is preferably used in a ball game where the user kicks or rolls the spherical body 10. The ball game is played similar to kickball, baseball, or softball, except the user doesn't have to race to a base to be safe upon striking or rolling the ball, but will be allowed to occupy, touch, or cross the base as determined by the outcome displayed faceup on the ball after the ball is allowed to come to rest upon the surface. The outcome described and displayed on the face 15*a–h* facing upwardly relative to the surface after the spherical body 10 comes to rest on the surface determines whether the user is out, receives a single, a double, a triple, or a home run similar to the conventional game of baseball where the offensive users are given three outs per offensive time.

The ball game is played indoors or outdoors on a surface convenient for kicking or striking the spherical body 10. Four base members 20–23 preferably made of a resilient material such as plastic, rubber, or the like are disposed in spaced relationship to one another on a surface similar to the layout commonly found on a baseball field. The base members 20–23 are substantially octagonally shaped and have indicia displayed thereon, which represent the positions of the base members 20–23 in a baseball or softball game. The first base member 20 preferably has the word "FIRST" and the numeral "1" displayed on the surface thereof and is colored to substantially match and correspond to the color of the face or faces 15*a–h* of the spherical body 10, which have the word "SINGLE" and the numeral "1" displayed thereon, and is positioned as the first base member 20. The second base member 21 preferably has the word "SECOND" and the numeral "2" displayed on the surface thereof, and is colored to substantially match and correspond to the color of the face or faces 15*a–h* of the spherical body 10, which have the word "DOUBLE" and the numeral "2" displayed thereon. The third base member 22 preferably has the word "THIRD" and the numeral "3" displayed on the surface thereof, and is colored to substantially match and correspond ho the face 15*a–h* of the spherical body 10, which has the word "TRIPLE" and the numeral "3" displayed thereon. The fourth base member 23 preferably has the numeral "4" and the word "HOME" displayed on the surface thereof and is colored to substantially match and correspond to the face of the spherical body 10, which has the words "HOME RUN" and the numeral "4" displayed thereon.

This ball game is primarily intended to allow the disadvantaged user to play a ball game on an equal basis with a user who is not disadvantaged. The user does not have to strike a moving ball nor catch a struck ball nor race to a base to beat out a struck ball in order to be safe as is commonly required in a conventionally played baseball or softball game. The user doesn't have to race to a base member upon striking the spherical body 10 in order to be safe. Instead, the outcome of the user striking the spherical body 10 is determined primarily by the outcome displayed or described on the face 15*a–h* of the spherical body 10 facing upwardly when the spherical body 10 comes to rest on the surface, except when the spherical body 10 is caught in the air by a defensive user, which counts as an out to the offensive users. If the spherical body 10 comes to rest with the face 15*a–h* having the word "DOUBLE" and the numeral "2" displayed thereon facing upwardly relative to the surface, the user responds to the outcome and is permitted to occupy second base. If there were any users on base prior to the user striking the spherical body 10, they would move up two base members accordingly. The number of base members the users are permitted to move up is determined by the outcome displayed on the face 15*a–h* of the spherical body 10 facing upwardly relative to the surface. A single moves a base member occupier up one base. A triple or home run scores all the base member occupiers. If the word "OUT" is displayed on the face 15 facing upwardly relative to the surface, the user is out and the offensive team or users are given an out.

In addition to permitting handicapped or less talented users to compete equally with nonhandicapped or more talented users in the same ball game, this ball game is also intended to teach children to match and identify substantially the same colors on the faces 15*a–h* facing upwardly relative to the surface with the colors on the base members 20–23 and also to match the meaning of the words on the faces 15*a–h* of the spherical body 10 facing upwardly with the corresponding synonyms and numbers on the base members 20–23. This ball game device and the method of using it not only provides entertainment and exercise for the users but also is a learning tool from which children, in particular, can learn to differentiate between colors and also to identify synonyms and like numbers.

Various changes and departures may be made to the invention without departing from the spirit and scope thereof. Accordingly, it is not intended that the invention be limited to that specifically described in the specification or as illustrated in the drawing but only as set forth in the claims.

What is claimed is:

1. A method of using a ball game device comprising, in combination, the steps of:

providing a playing surface having a plurality of base members disposed in spaced relationship to one another;

providing a generally spherical body made of a resilient material and having eight generally equally sized faces displaying indicia thereon and describing probable outcomes in a baseball game, said faces being flat-surfaced for resting upon said playing surface; putting said spherical body into play upon said playing surface; and responding to the outcome displayed upon said face being face up relative to said playing surface upon said spherical body coming to rest upon said playing surface.

2. A method of using a ball game device according to claim 1, wherein the step of providing base members further includes said base members which are octagonal shaped.

3. A method of using a ball game device according to claim 2, wherein said base members display words and numerals representing positions of said base members in a ball game.

4. A method of using a ball game device according to claim 3, wherein said faces are generally circular and are essentially flat indentations in said spherical body.

5. A method of using a ball game device according to claim 4, wherein said words displayed on said base members have synonyms displayed on said faces of said spherical body.

6. A method of using a ball game device according to claim 5, wherein said base members and said faces are distinctively colored, said base members and said faces displaying synonyms being of the same colors which facilitates said user matching said colors on said faces with said colors on said base members and matching and learning said synonyms.

7. A method of using a ball game device according to claim 6, wherein the step of responding to said outcome displayed face up on said spherical body further includes moving to said base member which corresponds to said outcome.

8. A method of using a ball game device according to claim 7, wherein the step of responding to said outcome further includes moving to said base member being of the same color as the color of said face facing upward on said spherical body.

9. A method of using a ball game device according to claim 8, wherein said step of moving to said base member further includes moving any user occupying a base member in correspondence to said outcome displayed on said spherical body.

* * * * *